US006196656B1

(12) United States Patent
Ghosh et al.

(10) Patent No.: US 6,196,656 B1
(45) Date of Patent: Mar. 6, 2001

(54) HIGH FREQUENCY ULTRASONIC CLEANING OF INK JET PRINTHEAD CARTRIDGES

(75) Inventors: Syamal K. Ghosh, Rochester; Edward P. Furlani, Lancaster; Dilip K. Chatterjee, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/179,498

(22) Filed: Oct. 27, 1998

(51) Int. Cl.[7] ..... B41J 2/165
(52) U.S. Cl. ..... 347/27; 347/35
(58) Field of Search ..... 347/27, 40, 34, 347/35; 29/890.1

(56) References Cited

U.S. PATENT DOCUMENTS

| | | | | |
|---|---|---|---|---|
| 4,500,895 | | 2/1985 | Buck et al. | 347/87 |
| 4,794,409 | | 12/1988 | Cowger et al. | 347/87 |
| 4,849,774 | | 7/1989 | Endo et al. | 347/56 |
| 5,103,244 | | 4/1992 | Gast et al. | 347/33 |
| 5,212,496 | * | 5/1993 | Badesha et al. | 347/45 |
| 5,248,998 | | 9/1993 | Ochiai et al. | 347/71 |
| 5,287,126 | | 2/1994 | Quate | 347/25 |
| 5,300,958 | | 4/1994 | Burke et al. | 347/28 |
| 5,311,218 | | 5/1994 | Ochiai et al. | 347/71 |
| 5,598,196 | | 1/1997 | Braun | 347/68 |
| 5,757,396 | * | 5/1998 | Bruner | 347/27 |

* cited by examiner

*Primary Examiner*—Thinh Nguyen
(74) *Attorney, Agent, or Firm*—Raymond L. Owens

(57) ABSTRACT

An ink jet printing apparatus for receiving an ink cartridge defining an orifice structure having at least one orifice plate with a plurality of nozzles for ejecting ink droplets onto a receiver to form an image. The apparatus cleans the orifice structure of debris, by using at least one actuable high frequency ultrasonic transducer in physical contact with the orifice structure and operatively associated with and spaced from the nozzles; and actuating the actuable high frequency ultrasonic transducer to cause such actuable high frequency ultrasonic transducer to produce ultrasonic sound waves which impinge upon the orifice structure and loosens debris.

2 Claims, 3 Drawing Sheets

HIGH FREQUENCY ULTRASONIC CLEANING OF INK JET PRINTHEAD CARTRIDGES

CROSS REFERENCE TO RELATED APPLICATION

Reference is made to commonly assigned U.S. patent applications Ser. No. 09/127,546 filed Jul. 31, 1998, by Ghosh et al, entitled "Non-Contact Ultrasonic Cleaning of Ink Jet Printhead Cartridges"; Ser. No. 09/159,725 filed Sep. 24, 1998, by Ghosh et al, entitled "Ultrasonic Cleaning of Ink Jet Printhead Cartridges"; and Ser. No. 09/132,628 filed Aug. 11, 1998, by Ghosh et al, entitled "Vacuum Assisted Ultrasonic Cleaning of Ink Jet Printhead Cartridges", the teachings of which are incorporated herein by reference.

FIELD OF THE INVENTION

This invention relates to high frequency ultrasonic transducer for cleaning of ink jet printhead cartridges wherein the high frequency ultrasonic transducer is in physical contact with the orifice plate.

BACKGROUND OF THE INVENTION

Typically, an ink jet printer has at least one printing cartridge from which droplets of ink are directed towards a receiver. Within the cartridge, the ink may be contained in a plurality of channels and energy pulses are used to cause the droplets of ink to be ejected on demand or continuously, from nozzles or orifices in a plate in an orifice structure.

In a thermal ink jet printer, the energy pulses are generally provided by a set of electrical resistors, each located in a respective one of the channels, each one of them is individually addressable by current pulses to instantaneously heat and form a droplet or bubble in the channels which contact the resistors.

Operation of thermal ink jet printer is described in details in U.S. Pat. Nos. 4,849,774; 4,500,895; and 4,794,409.

On the other hand, a piezoelectric ink jet printing system includes a body of piezoelectric material defining a plurality of parallel open topped channels separated by walls. The walls have metal electrodes on opposite sides thereof to form shear mode actuators for causing droplets to expel from the channels. An orifice structure comprising at least one orifice plate defining the holes through which the ink droplets are ejected is bonded to the open end of the channels. The electrical energy pulses are applied to the parallel electrodes causing the channels to shear actuating the expulsion of droplets from the orifice plate. Operation of piezoelectric ink jet print heads is described in details in U.S. Pat. Nos. 5,598,196; 5,311,218; and 5,248,998.

Ink jet printing cartridges, whether it is of thermal or piezoelectric kind, use a variety of functional components, all of which must cooperate in a precise manner to achieve maximum efficiency. One of the most important components is an orifice plate having a plurality of orifices or nozzles therein.

The nozzles are usually circular in cross section and the diameter of the nozzles may vary from 10 to 100 $\mu$m as required by the specification of the printer.

Higher the resolution of the printed output, smaller is the ink droplet thereby requiring smaller diameter nozzles or orifices. Ink is ejected through these openings during printing operation. To obtain defect-free printing output, the orifice plates and all the nozzles must be kept clean and free of debris and any kind of obstructions to ink flow at all times. If the orifice plate and nozzles are not clean, many problems can occur thereby undermining the performance of the printer. As for example, paper fibers and other debris accumulated on the orifice plate surface and inside the nozzles can affect the quality of the printed images.

Similarly, debris can be dried ink crusts and paper dust on the orifice plate as well as in the ink channels and the nozzles can cause the printer to perform poorly.

The foregoing problems are overcome, as described in U.S. Pat. No. 5,300,958 to Burke et al, by providing "maintenance or service stations" within the main printer unit. The maintenance stations are designed such that when the printhead ink cartridge is not operating and is in a "parked" position, the cartridge is situated in the maintenance station outside the printing zone for the purpose of routine cleaning of the cartridges. The maintenance station has many components which are designed to serve many functions. These functions include: (a) priming the printhead cartridge, (b) capping the orifice plate and nozzles (orifices) therein when the printhead is not in operation, (c) wiping contaminants from the orifice plate, (d) preventing ink from drying out in the openings of the orifice plate, and (e) providing a receptacle for discarding the cleaned debris.

To accomplish this cleaning, the U.S. Pat. No. 5,103,244 discloses a structure in which a multi-blade wiper is used. The desired cleaning is performed by dragging a printhead (cartridge) across the selected wiper blade.

The wiper mechanism also includes a plurality of resilient blades each having an octagonal shape and rotatable about an axis.

Another cleaning structure disclosed in U.S. Pat. No. 5,300,958, includes a printhead wiper unit consisting of a single or dual members positioned against each other to form a capillary pathway therebetween. The cartridge includes a compartment having an opening therethrough and an absorbent member impregnated with cleaning solution.

Still another cleaning structure is disclosed in U.S. Pat. No. 5,287,126 which includes a vacuum cleaner to help clean the orifice plate. The vacuum cleaner is comprised of a top cover plate, having a plurality of air passages, that is located over a channel surface by spacers. A pressure differential in the defined volume between the top cover plate, the channel surface, and the spacers below the external pressure, so that air is drawn into the defined volume through the air passage. The resulting air flow removes ink, dust and debris from the vicinity thereby keeping the cartridge clean.

SUMMARY OF THE INVENTION

It is an object of the present invention to provide improved cleaning of ink jet printhead cartridges.

It is another object of the present invention to provide a more efficient printhead cartridge cleaning system which permits a controlled dislodging of debris accumulated in the nozzles and the orifices of the orifice structure, discarding the debris without contaminating and damaging the cartridges and thereby cleaning the printhead cartridges efficiently.

It is another object of the present invention to provide an apparatus for cleaning an ink jet printhead cartridge which is compact, robust and efficient.

It is yet another object of the present invention to provide a cleaning apparatus which does not abrade or damage the ink jet cartridges.

These objects are achieved in an ink jet printing apparatus for receiving an ink cartridge defining an orifice structure having at least one orifice plate with a plurality of nozzles for ejecting ink droplets onto a receiver to form an image, means for cleaning the orifice structure of debris, comprising:

(a) at least one actuable high frequency ultrasonic transducer in physical contact with the orifice structure and operatively associated with and spaced from the nozzles; and (b) means for actuating the actuable high frequency ultrasonic transducer to cause such actuable high frequency ultrasonic transducer to produce ultrasonic sound waves which impinge upon the orifice structure and loosens debris.

Advantages of the invention include:

Overcoming many of the disadvantages of the existing technology, such as damage of the orifice plates due to wear, abrasion and distortion;

Cost-effective electronic integration of the high frequency actuable high frequency ultrasonic transducer to clean ink jet printhead cartridge;

Use of solvents and other undesirable chemicals can be avoided;

The active surface of the actuable high frequency ultrasonic transducer is flat so that it comes in intimate physical contact with a flat orifice plate of an ink jet cartridge; and Use of a replaceable blotting element that effectively removes and dries the surface of the orifice plate.

It is an important feature of the present invention to involve at least one actuable high frequency ultrasonic transducer to be in physical contact with the orifice plate of an ink jet cartridge for effectively cleaning the ink jet printhead cartridge of debris.

DETAILED DESCRIPTION OF THE PREFERRED EMBODIMENT

Figure 1:
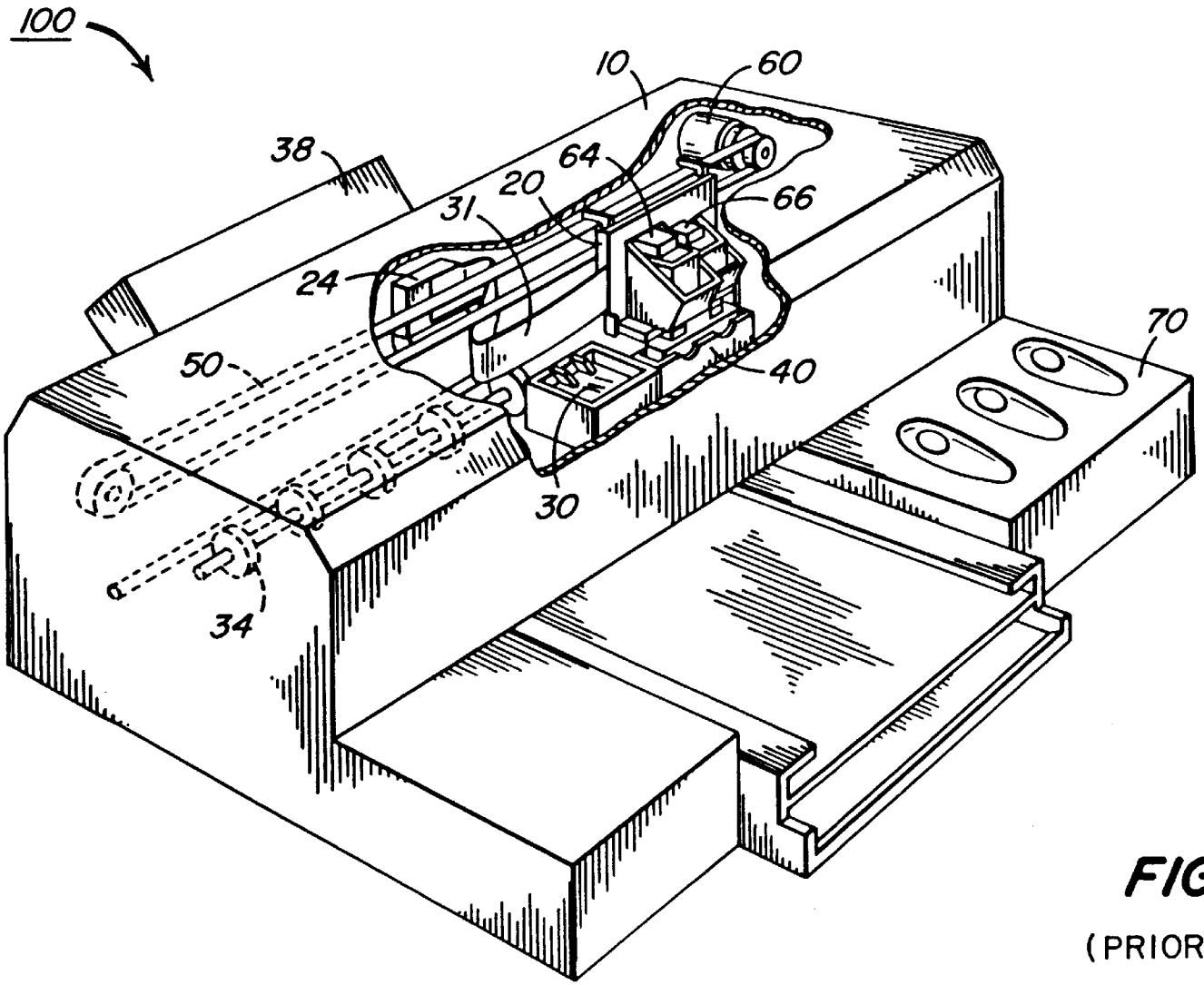
FIG. 1 (PRIOR ART)
FIG. 1 is a perspective of an ink jet printer depicting the prior art.

Referring to FIG. 1, a typical ink jet printer 100 of prior art is described. Ink jet printer 100 is of the type in which the printing is done in a substantially horizontal plane, includes a printer housing 10, a printhead carriage 20, a carriage rod 32 (see FIG. 2), drive roller assembly 34, paper supply 38, which contains receivers, and maintenance station 40. Wiper platform 30 is a part of the maintenance station 40. Drive roller assembly 34 feeds paper, or other print media of choice supplied to it from the paper supply 38 to a printing zone disposed between printhead carriage 20 and the platen (not shown) in a manner well known to artisans. Printhead carriage 20 travels back and forth on carriage rod 32 as shown by the arrow 73 (see FIG. 2) through the printing zone. Printhead carriage 20 is moved bi-directionally typically by means of a drive belt. 50 connected to a carriage motor 60. Printhead carriage 20 includes ink cartridges 64 and 66 (only two cartridges are shown here) which are connected by a flexible electrical interconnect strip 31 to a microprocessor 24 which also controls carriage motor 60. A control panel 70 is electrically associated with microprocessor 24 for selection of various options relating to printing operation. Such control operation and the printing mechanism of an ink jet printer is well known in the prior art and hereby form no part of this invention.

The present invention provides an apparatus for cleaning an ink jet printhead cartridge which uses a high frequency actuable high frequency ultrasonic transducer in contact with an orifice plate of an ink jet cartridge. The actuable high frequency ultrasonic transducers can be brought in contact with the orifice structure of the cartridges intended for cleaning without having any liquid or other ultrasound coupling medium transposed between the transducer and the orifice plate (structure).

The major components of a typical high frequency actuable transducers 80, 82, 84 and 86 include a generator or power amplifier 120 (see FIG. 3) that converts conventional 50 Hz alternating current at 110 or 220 volts to greater than 100 kHz electrical energy at approximately 1,000 volts. This high frequency electrical energy is fed to a converter where it is transformed to mechanical vibration. The heart of an high frequency ultrasonic transducer comprises ceramic piezoelectric materials, e.g., two or more PZT (lead-zirconate1 titanate) bodies of any convenient shape which, when subjected to an alternating current, expand and contract. The piezoelectric bodies vibrate in the longitudinal direction and this motion is transmitted to the transducer head.

The high frequency ultrasonic transducer is formed of materials having a high mechanical Q, thus minimizing the attenuation experienced by the ultrasonic energy as it is transmitted through this transducer.

Preferably, aluminum, titanium or an aluminum or titanium alloy having a mechanical Q greater than 50,000 is used. Examples of suitable aluminum alloys include duralumin, aluminum alloy 7075, aluminum alloy 2024, and aluminum alloy 6061. An example of a titanium alloy which transmits ultrasonic energy efficiently is Ti-6AI-4V. Vibration frequency of the high frequency ultrasonic transducer to dislodge particles in the orifice structure must be in the range of 100 kHz to 5 MHz.

Figure 2:
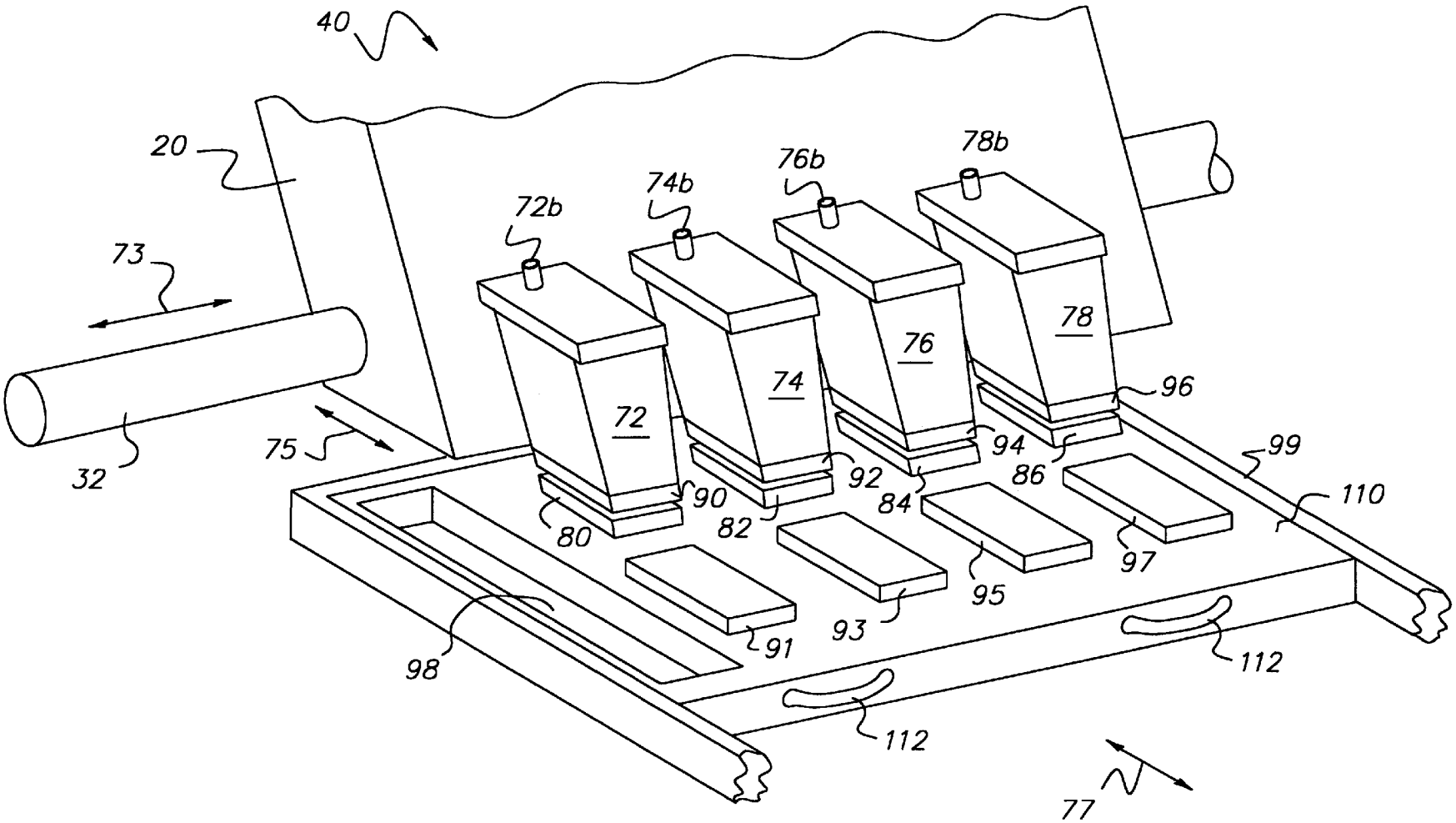
FIG. 2. is an enlarged partial isometric view of the maintenance station including high frequency high frequency ultrasonic transducers.

Now referring to FIG. 2, a detailed description of the maintenance station 40 of the present invention will now be provided. The maintenance station 40 incorporates one or more high frequency actuable transducers 80, 82, 84, and 86 which transmit acoustic energy directly to the orifice plates 90, 92, 94, and 96 respectively. The high frequency actuable transducers 80, 82, 84, and 86 are mounted rigidly on a slidable platform 110 comprising metals like aluminum or steel or heavy duty plastics. The slidable platform also contains a waste receptacle 98 for receiving discarded ink during ink ejecting or spitting operation. Four blotting elements 91, 93, 95, and 97 are mounted on the slidable platform 110 which is supported by a frame 99. The slidable platform 110 can be pulled out as shown by the bidirectional arrow 77 using platform handles 112 for ease of replacing the blotting elements 91, 93, 95, and 97 and maintenance of the high frequency actuable transducers 80, 82, 84, and 86. The blotting elements 91, 93, 95, and 97 are mounted on the slidable platform 110 using double sided adhesive tapes. The blotting elements 91, 93, 95, and 97 are made from the materials selected from polymeric foam, rubber foam, cotton fabric, and paper products.

Four ink jet printhead cartridges 72, 74, 76 and 78 are shown here to describe fully the embodiment of the present invention. For purposes of the illustrative embodiment described in this invention, cartridge 72 utilizes black ink while cartridges 74, 76, and 78 could use only cyan, yellow, and magenta ink, respectively. The cartridges 72, 74, 76 and 78 are each provided with an orifice structure that can define ink channels (not shown) but will necessarily include orifice plates 90, 92, 94, and 96 through which ink droplets are ejected to a receiver. Furthermore, any number of different colored ink cartridges 72, 74, 76 and 78 could be used, as warranted by the application of the printer 100 (see FIG. 1). Typically, ink jet cartridges 72, 74, 76, and 78 are piezoelectric ink jet printheads, but other kinds of cartridges, as for example, thermal cartridges may also be acceptable and useful in this invention.

The orifice plates 90, 92, 94, and 96 of the ink jet cartridges 72, 74, 76 and 78 are brought in close contact with the high frequency transducers 80, 82, 84, and 86, respectively at a first cleaning position and they are subjected to vibration for necessary dislodging of the debris. The cartridges 72, 74, 76, and 78 are then moved to another cleaning position close to a waste receptacle 98 and ink is spritzed. This ink spritz causes the discarding of loosened debris into the waste receptacle 98. The ink jet cartridges 72, 74, 76, and 78 are then moved to a third cleaning position close to the blotting elements 91, 93, 95, and 97, respectively which wipe the orifice plates 90, 92, 94, and 96. Those skilled in the art will appreciate that a mechanism can be used to automatically cover or cap the orifice plates when in an inactive condition. The cap is removed when the apparatus is to resume printing. The blotting elements 91, 93, 95 and 97 are each dedicated to a corresponding ink jet cartridges 72, 74, 76, and 78, respectively, for the purpose of eliminating any cross contamination of debris. In other words, the actuable high frequency ultrasonic transducers 80, 82, 84, and 86 are controlled electronically by the microprocessor 24 through a feedback circuit (not shown).

The maintenance station 40 of FIG. 2 will be understood by those skilled in the art to be located in a region outside the printing zone at one end of the bidirectional movement, shown by the arrow 73, of carriage 20. Cleaning is accomplished when the ink jet cartridges 72, 74, 76, 78 as they are moved by the carriage rod 32 to the cleaning positions. The printhead carriage 20 is moved orthogonal to the direction of the carriage rod 32 axis as shown by an arrow 75.

Figure 3:
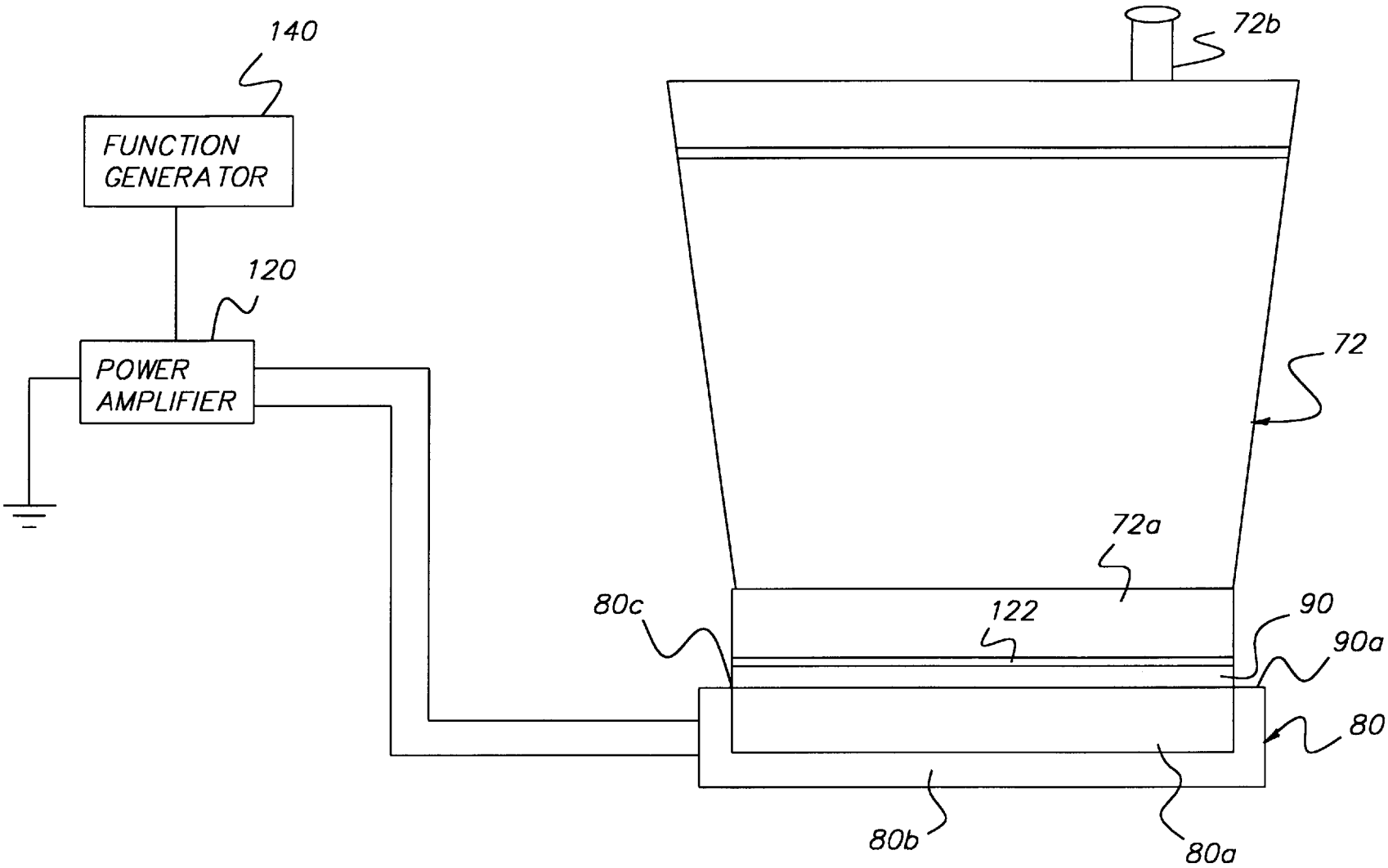
FIG. 3 is a side view of an ink jet printhead cartridge of FIG. 2. showing a transducer in physical contact with the orifice plate.

Referring to FIG. 3, a side view of the printhead cartridge 72 is shown. This shows the orifice structure 122 and the orifice plate 80 in physical contact with the high frequency ultrasonic transducer 80. The piezoelectric element 80*a* of the transducer 80 comprising piezoelectric ceramic is encased in a metal housing 80*b*. Active surface 80*c* of the high frequency ultrasonic transducer 90 is flat matching the opposing flat surface 90*a* of the orifice plate 90. The transducer is energized by a power amplifier 120 through a function generator 140. The ink cartridge 72 includes an ink inlet 72*b* which is connected to the ink channels (not shown) inside the piezoelectric ink jet head 72*a* which in turn is bonded to the orifice plate 90. The ink channels inside the piezoelectric ink jet head 72*a* are connected to the orifice structure 90 which will be understood by those skilled in the art. The orifice plate 90 is generally made of electroformed nickel and the exterior surface is coated with gold to reduce corrosion caused by chemically active species in ink. Since the flat surface 90*a* of the orifice plate 90 will be in physical contact with the active surface 80*c* of the piezoelectric ceramic 80*a* of the high frequency ultrasonic transducer 80, it is important that a wear resistant as well as corrosion resistant coating be applied over the electroformed nickel. Physical vapor deposited thin diamond-like carbon coating over electroformed nickel surface will dramatically improve the resistance to abrasion, wear and corrosion. Diamond-like carbon coating thickness must range from 500 Angstrom to 5 micro-meter.

In view of the above description, it is understood that modifications and improvements will take place to those skilled in the art which are well within the scope of this invention. The above description is intended to be exemplary only wherein the scope of this invention is defined by the following claims and their equivalents.

The invention has been described in detail with particular reference to certain preferred embodiments thereof, but it will be understood that variations and modifications can be effected within the spirit and scope of the invention.

PARTS LIST

10 printer housing
20 printhead carriage
24 microprocessor
30 wiper platform
31 electrical interconnect strip
32 carriage rod
34 drive roller assembly
38 paper supply
40 maintenance station
50 drive belt
60 drive motor
64 ink cartridge
66 ink cartridge
70 control panel
72 black ink cartridge
72*a* piezo-electric ink jet head
72*b* inlet for black ink
73 bi-directional arrow
74 cyan ink cartridge
74*b* inlet for cyan ink
75 bi-directional arrow
76 yellow ink cartridge
76*b* inlet for yellow ink
77 bi-directional arrow
78 magenta ink cartridge
78*b* inlet for magenta ink
80 high frequency ultrasonic transducer
80*a* piezoelectric element
80*b* metal housing
List cont'd
80*c* active surface
83 high frequency ultrasonic transducer
84 high frequency ultrasonic transducer
86 high frequency ultrasonic transducer
90 orifice plate
91 blotting element
90*a* flat surface
92 orifice plate
93 blotting element
94 orifice plate
95 blotting element
96 orifice plate
97 blotting element
98 waste receptacle
99 frame
100 ink jet printer
110 slidable platform
112 platform handle
120 power amplifier
122 orifice structure
140 function generator

What is claimed is:

1. An ink jet printing apparatus for receiving an ink cartridge defining an orifice structure having at least one plate with a plurality of orifices for ejecting ink droplets onto a receiver to form an image, comprising:

(a) means for moving the orifice structure to first, second, and third cleaning position and means disposed at such cleaning position for cleaning the orifice structure of debris, comprising:

(b) at least one actuable high frequency high frequency ultrasonic transducer disposed at the first cleaning position and operatively associated with and in contact with the orifice plate;

(c) means for actuating the actuable high frequency high frequency ultrasonic transducer to cause such actuable high frequency ultrasonic transducer to produce ultrasonic sound waves which produce high frequency vibration upon the orifice structure and loosens debris;

(d) the orifice structure including a wear resistant thin coating on the surface of the orifice plate, wherein the wear and corrosion resistant thin coating is diamond-like carbon;

(e) means for squirting ink through the orifice structure to discard debris formed in the orifice structure at the second cleaning position to avoid any cross contamination; and (f) means disposed at the third cleaning position for blotting the ink from the surface of the high frequency ultrasonic transducer.

2. The ink jet printing apparatus of claim 1 wherein the thickness of the diamond-like carbon coating ranges from 500 Angstrom to 5 micrometer.

* * * * *